US006714162B1

(12) United States Patent
Kadambi et al.

(10) Patent No.: US 6,714,162 B1
(45) Date of Patent: Mar. 30, 2004

(54) NARROW WIDTH DUAL/TRI ISM BAND PIFA FOR WIRELESS APPLICATIONS

(75) Inventors: Govind R. Kadambi, Lincoln, NE (US); Blaine R. Bateman, Louisville, CO (US); Michael G. Volkmer, Lincoln, NE (US); Gary A. Cumro, Alvo, NE (US); Bradley S. Haussler, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 10/269,203

(22) Filed: Oct. 10, 2002

(51) Int. Cl.[7] ..... H01Q 1/38

(52) U.S. Cl. ..... 343/700 MS; 343/815; 343/846

(58) Field of Search ..... 343/700 MS, 702, 343/846, 848, 815

(56) References Cited

U.S. PATENT DOCUMENTS 5,420,596 A * 5/1995 Burrell et al. ..... 343/700 MS
5,966,097 A * 10/1999 Fukasawa et al. ... 343/700 MS
6,218,991 B1 * 4/2001 Sanad ..... 343/700 MS
6,222,496 B1 * 4/2001 Liu ..... 343/846
6,297,776 B1 * 10/2001 Pankinaho ..... 343/700 MS
6,346,914 B1 * 2/2002 Annamaa ..... 343/700 MS
6,421,014 B1 * 7/2002 Sanad ..... 343/700 MS
6,456,249 B1 * 9/2002 Johnson et al. ..... 343/702

* cited by examiner

*Primary Examiner*—Tan Ho
(74) *Attorney, Agent, or Firm*—Holland & Hart

(57) ABSTRACT

This invention presents new and alternative design techniques of single feed Dual/Tri ISM band PIFA for wireless system applications. To attain the advantages of and in accordance with the purpose of the present invention, dual and/or tri ISM band PIFA antennas are provided. In particular, an antenna comprises at least a ground plane, a radiating element, a short, and a feed tab. The short provides a connection between the ground plane and the radiating element. The feed tab connected to the radiating element provides RF power and provides initial impedance match. While the feed tab provides initial impedance match, additional impedance match and frequency control are obtained by the inclusion of one or more of a parasitic element, a slot, tuning stubs, and capacitive elements.

50 Claims, 13 Drawing Sheets

NARROW WIDTH DUAL/TRI ISM BAND PIFA FOR WIRELESS APPLICATIONS

FIELD OF THE INVENTION

The present invention relates to Planar Inverted F-Antenna (PIFA), and in particular, to a single feed dual or tri ISM band PIFA of narrow width having a compact ground plane.

BACKGROUND OF THE INVENTION

The world has witnessed a rapid progress in wireless communication. The emerging technology of short range radio links (such as the Bluetooth protocol or the like) and local area network system applications have caused a renewed focus on the industrial scientific medical ("ISM") frequency band. Conventionally, ISM band RF data communication devices use external antenna. But these devices could use internal antenna to avoid protruding external antenna. Internal antennas have several advantages such as being less prone to external damage, a reduction in overall size of the handset, and increased portability.

Among the various choices for internal antennas, the planer inverted F-antenna ("PIFA") appears to have great promise. Relative to other internal antennas, the PIFA is generally lightweight, easy to adapt and integrate into a device chassis, has moderate range of bandwidth, has omni directional radiation patterns in orthogonal principal planes for vertical polarization, versatile for optimization, and multiple potential approaches for size reduction.

The PIFA also finds useful applications in diversity schemes. Its sensitivity to both the vertical and horizontal polarization is important for mobile cellular/RF data communication applications because of the absence of fixed orientation of the antenna as well as the multi path propagation conditions. All these features render the PIFA to be a good choice as an internal antenna for mobile cellular/RF data communication applications.

Regarding the single ISM band PIFA technology, the thrust of research has been on optimal performance with the miniaturization in the sizes of both the antenna and the ground plane. Recently, however, there is a gradual shift of the emphasis from the existing single ISM band operation to dual or tri ISM band operating covering the frequency ranges of 2.4–2.5, 5.15–5.35, and 5.47–5.725 GHz. This calls for the development of dual or tri ISM band antennas for applications in wireless communication. There exists a continued interest and requirement for the compact dual and/or tri ISM band PIFA for emerging applications of RF data wireless systems comprising laptop computer and other handheld electronic devices, such as, for example, PDAs, electronic games, cellular phones, etc.

Unlike the case of PIFA for cellular applications, in wireless RF data communication systems, there exist variations on the sizes of the radiating element and ground plane as well as on the choice of preferred placement of the PIFA within the device.

In the majority of single feed cellular dual band PIFAs, quasi-physical partitioning of the radiating element facilitates dual frequency operation. Conventionally, a slot (straight, inclined, or L-shaped) forms a quasi-physical partitioning of the radiating element to facilitate the desired physical partitioning of the PIFA structure. When the system requirements impose stringent restrictions on the allowable width of the radiating element or ground plane, such as, for example, widths as low as about 1 to about 3 mm, the conventional dual band PIFA design invoking hitherto proven slot technique can prove to be a difficult, if not impossible, task.

A conventional dual band PIFA 70 with a single feed is illustrated in FIGS. 13A and 13B. Dual band PIFA 70 has a radiating element 301 and a ground plane 302. An L-shaped slot 303 on the radiating element 301 creates a quasi-physical partitioning of the radiating element 301. The segment on the radiating element 301 with dimensions of length (L1) and width (W1) resonates at the lower frequency band of the multi band operation. Conventionally, dual band (2.4–2.5/5.15–5.35 GHz) PIFA 70 has operating dimensions of lengths between 19.16–18.38 mm for (L1) and between 12.07–11.58 mm for (W1). The segment on the radiating element 301 with dimensions of length (L2) and width (W2) resonates at the upper frequency band of the multi band operation. Conventionally, the partition results in typical operating dimensions between 8.93–8.59 mm for (L2) and 5.63–5.41 mm for (W2). A power feed hole 304 is located on the radiating element 301. A connector feed pin 305*a*, used for feeding radio frequency (RF) power to the radiating element 301, is inserted through the feedhole 304 from the bottom surface of the ground plane 302. The connector feed pin 305*a* is electrically insulated from the ground plane 302 where the feed pin passes through the hole in the ground plane 302. The connector feed pin 305*a* is electrically connected to the radiating element 301 with solder at 306*a*. The body of the feed connector 305*b* is connected to the ground plane 302 at 306*b*with solder. The connector feed pin 305*a* is electrically insulated from the body of feed connector 305*b*. A through hole 307 is located on the radiating element 301. A conductive post 308 is connected to the radiating element 301 at 309*a* with solder. The conductive post 308 also is connected to the ground plane 302 at 309*b* with solder. The dual band impedance match of the radiating element 301 is determined by the diameter of the connector feed pin 305*a*, the diameter of the conductive shorting post 308 and the separation distance between the connector feed pin 305*a* and the conductive shorting post 308. The main disadvantage of the configuration of the multi band PIFA 70 is the lack of simple means of adjusting the separation of lower and upper resonant frequency bands. The change in the separation of the resonant frequency bands requires the repositioning of the slot 303. The above configuration is also associated with a constraint on the realizable bandwidth centered on the dual resonant frequencies of the PIFA 70.

Thus, it would be desirous to develop a dual or tri band PIFA antenna using a relatively compact antenna construct. In a related study and yet distinct from the proposed invention, the design of a single feed tri band PIFA or dual cellular and non cellular (GPS or ISM) applications has been reported in U.S. patent application Ser. No. 10/135,312, filed Apr. 29, 2002, of Kadambi et al., titled "A Single Feed Tri Band PIFA with Parasitic Element," which is incorporated herein by reference.

SUMMARY OF THE INVENTION

This invention presents new and alternative design techniques of single feed Dual/Tri ISM band PIFA for wireless system applications. To attain the advantages of and in accordance with the purpose of the present invention, dual and/or tri ISM band PIFA antennas are provided. In particular, an antenna comprises at least a ground plane, a radiating element, a short, and a feed tab. The short provides a connection between the ground plane and the radiating element. The feed tab connected to the radiating element provides RF power and provides some frequency control. While the feed tab provides some frequency control, additional frequency control is obtained by the addition of one or more of a parasitic element, a slot, tuning stubs, and capacitive elements.

The foregoing and other features, utilities and advantages of the invention will be apparent from the following more particular description of a preferred embodiment of the invention as illustrated in the accompanying drawings.

BRIEF DESCRIPTION OF THE DRAWING

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

The present invention will be described with reference to FIGS. 1–12. Using a combination of tuning devices and shorted parasitic elements, with or without slots in the radiating element, this invention presents the design of a dual and/or tri ISM band PIFAs having a relatively compact construct. The tuning devices and parasitic elements in the present invention can control the resonant frequency and the bandwidth of the dual and/or tri ISM frequency of operation. The location, the size (height, length, and width, also referred to as dimensions) and the relative orientation of the parasitic element and or tuning devices with respect to the radiating element control the tuning performance. Non limiting embodiments of the present invention have radiating elements and ground planes (as explained further below) with similar widths. While different widths are possible, it has been found that keeping the widths consistent results in a more compact structure. Further, the exemplary dimensions provided in this application are largely dictated by manufacturing tolerances; thus, the range of possible dimensions provided should be considered non limiting examples.

Designing a compact PIFA without using conventional slot techniques to partition the radiating element, while also restricting the allowable height and width, is formidable. Thus, to maintain a compact structure, the present invention is capable of incorporating a slot into the radiating element. In conventional dual band PIFA designs, the contour, size, and position of the slot play an important role. For a chosen contour and position of the slot, the size of the slot can be a tuning parameter to control the resonance of the PIFA. The variation in the size, contour and position of the slot influences the lower and upper resonant frequencies of the PIFA. Identification of the other specific parameters which facilitate rather independent control of the lower and upper resonance characteristics of the dual and/or tri band PIFA can enhance the ease of antenna tuning in many design applications. With this in view, this invention proposes the design of extremely narrow width dual and/or tri ISM band PIFA invoking both a slot and a parasitic element with a desirable provision to independently control the lower and the upper resonance to accomplish the feature of ease of tuning. The relative independent tuning of the upper and lower resonance characteristics of the dual or tri band of this invention is realized by the selective placement of tuning stubs of appropriate and pre-desired sizes. This invention also presents a feasibility of applying the slot technique in the design of compact dual and/or tri ISM band PIFA with extremely narrow width.

Figure 13A:
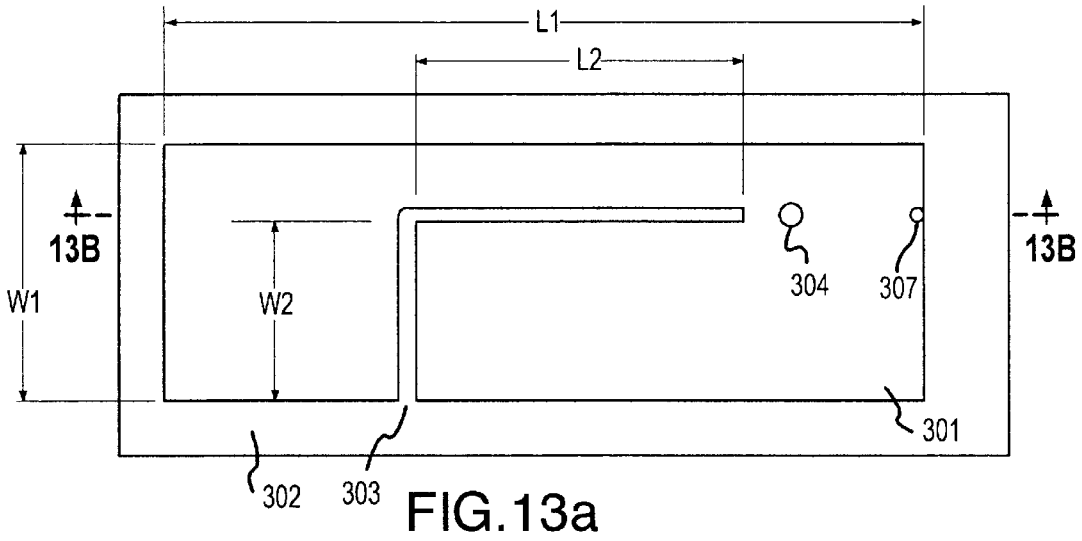
FIG. 13 shows a conventional slotted PIFA.
Figure 13B:
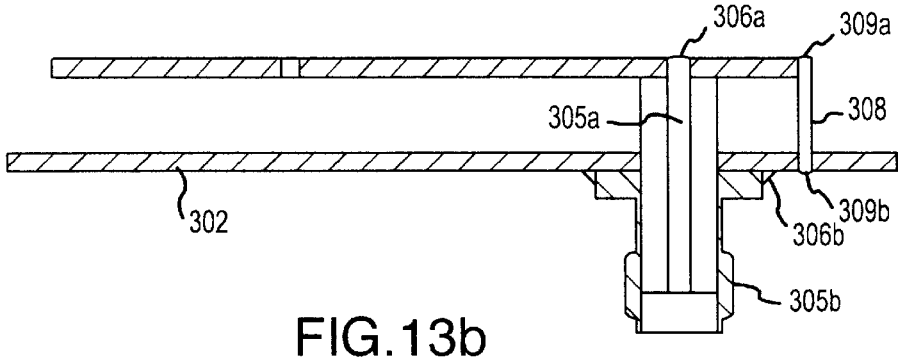

In most of the research publications and patents on PIFA technology, the major success has been the design of a single feed PIFA with dual resonant frequencies resulting essentially a dual band PIFA. In view of the inherent bandwidth limitation associated with conventional PIFA designs, most of the prior art single feed dual band PIFAs exhibit useful and desirable performance to cover only two frequency bands. U.S. Pat. No. 5,926,130 and the paper by Liu et al. entitled "Dual Frequency Planar Inverted—F Antenna" IEEE Trans. Antenna and Propagation, Vol. AP-45, No. 10, pp. 1451–1548, October 1997, incorporated herein by reference, are examples of the prior art single feed dual band PIFA. FIG. 13, herein, illustrates a prior art configuration of a conventional single feed dual band PIFA.

The design proposed in this invention realizes the tri band operation of the PIFA by using the L-shaped as well as T-shaped slot. Although the application of L-shaped slot is common in many single feed dual band PIFA designs, use of the T-shaped slot in the PIFA is novel. Further, this invention also suggests the combination of shorted parasitic element and the slot on the radiating element to accomplish single feed dual or tri ISM performance of the PIFA.

Figure 1A:
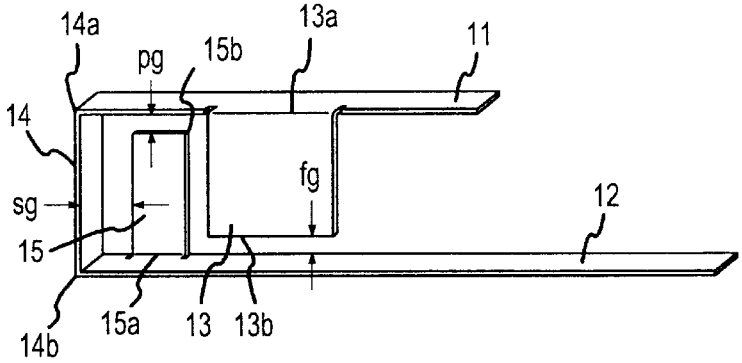
FIG. 1 shows an embodiment of a PIFA illustrative of the present invention.
Figure 1B:
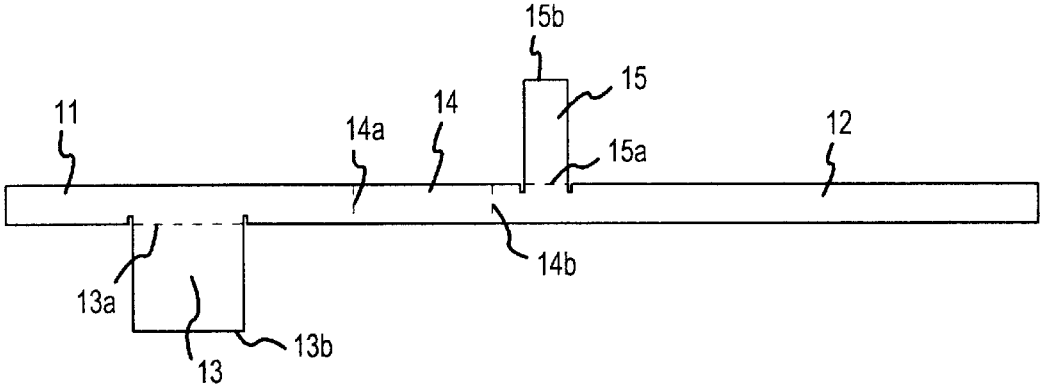

Now to FIG. 1, a PIFA 10 illustrative of one embodiment of the present invention is shown. FIG. 1A shows PIFA 10 in a bent configuration having a radiating element 11, a ground plane 12, a feed tab 13 formed of a first conductive material, such as a copper strip, a short 14 formed of a second conductive material, which could be the same or different from the first conductive material, and a shorted parasitic element 15 formed of a third conductive material, which could be the same or different from the first and second conductive material. FIG. 1B shows PIFA 10 in a flat configuration. Thus, PIFA 10 could be made using a single piece of metal appropriately cut and bent into the proper configuration. As can be seen in FIGS. 1A and 1B, PIFA 10 does not contain a slot, although one of ordinary skill in the art on reading the disclosure would understand a slot could be incorporated into the design.

Feed tab 13 has a first feed tab edge 13*a* connected to radiating element 11. In the bent configuration, feed tab 13 has a second feed tab edge 13*b* residing above ground plane 12. A feed tab gap fg exists between second feed tab edge 13*b* and ground plane 12. A conventional coaxial cable power feed (not shown) attaches a center conductor of the coaxial cable to second feed tab edge 13*b* to supply power to the radiating element. An outer shield of the coaxial cable attaches to ground plane 12. Short 14 has a first short edge 14*a* attached to radiating element 11 and a second short edge 14*b*attached to ground plane 12 providing a short between radiating element 11 and ground plane 12. Short 14 facilitates a quarter wavelength operation for radiating element 11. Parasitic element 15 has a first parasitic edge 15*a*connected to ground plane 12. In the bent configuration, parasitic element 15 has a second parasitic edge 15*b* residing below radiating element 11. A parasitic element gap pg exists between second parasitic edge 15*b* and radiating element 11. A short gap sg exists between the parasitic element 15 and short 14. Parasitic element 15 forms the tuning element to control an upper resonant frequency of radiating element 11. As shown by the flat configuration, parasitic element 15 and feed tab 13 are on opposite sides of short 14.

PIFA 10 functions as a single feed dual ISM band PIFA. The resonant frequency of the lower frequency band and the bandwidth center for radiating element 11 are determined by the dimensions of radiating element 11, the size of ground plane 12, the location and width of feed tab 13 on radiating element 11, and the width of short 14 and the distance between radiating element 11 and ground plane 12.

The resonant frequency of the lower frequency band and the bandwidth of radiating element 11 are determined by the location and width of shorted parasitic element 15 on ground plane 12, the gap pg, the gap sg, and the height of PIFA 10. While parasitic element 15 tunes the upper frequency band, it has little or no influence on tuning the lower frequency band. The coaxial cable power feed (not shown) attached to second feed tab edge 13*b*influences the tuning of the upper frequency band, also.

Thus, different elements tune the radiating element's lower frequency band and upper frequency band. This allows the upper and lower frequencies to be varied separately.

Figure 2:
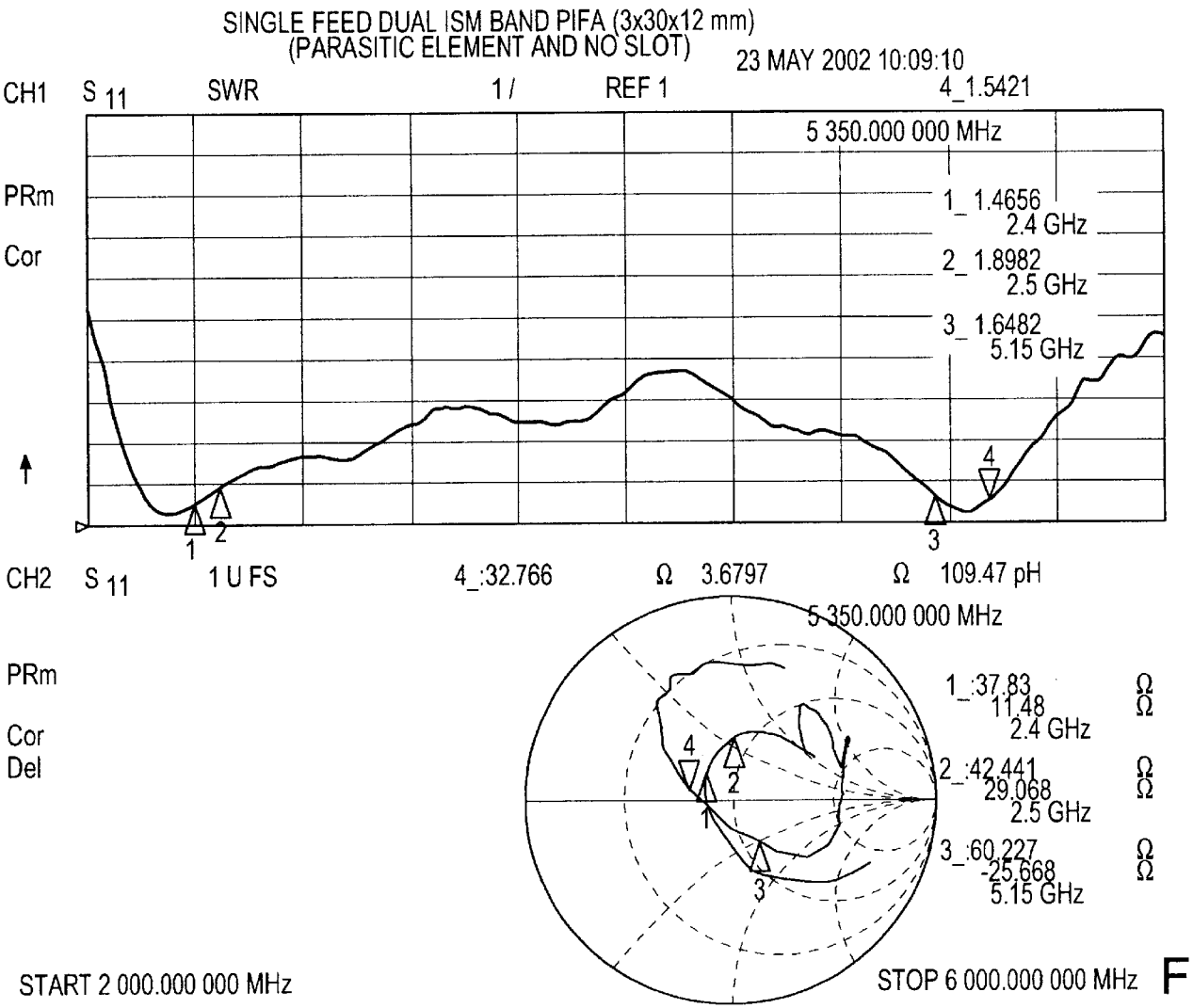
FIG. 2 shows VSWR and impedance characteristics of a sample PIFA 10.

A single feed dual ISM band PIFA 10 tuned to lower and upper frequencies of 2.4–2.5 and 5.15–5.35 GHz was designed and tested. FIG. 2 shows plots of VSWR and the impedance characteristics of a possible PIFA 10 with these frequencies. The VSWR plot indicates satisfactory bandwidth for the dual ISM Band operation of PIFA 10, which is devoid of the conventional slot configuration. Using the parasitic element, a traditional single band PIFA can be made into a dual band PIFA without increase in the overall size or volume of the antenna. As can be seer, from the flat configuration, shown in FIG. 1B, PIFA 10 is designed so that a single sheet can be bent to form the antenna, although multiple sheets and solder could be used also. The results shown in FIG. 2 are based on radiating element 11 having dimensions 3(W)×30(L)×12(H) mm and ground plane 12 having dimensions 3(W)×42(L). These dimensions are exemplary, however, and one of ordinary skill in the art would understand the dimensions could vary over a wide range. The width of the radiating element can be as small as 2 mm and it can be as wide as 8–9 mm. The smallest width of the ground plane should be just the width of the radiating, element itself. The maximum width of the ground plane can be slightly or much bigger than the width of the radiating element. The minimum length of the ground plane should be just the length of the radiating element, itself. The maximum width of the ground plane can be slightly or much bigger than the length of the radiating element. It is pertinent to point out that any reduction in the width of the radiating element needs to be adequately compensated by a proportional or corresponding increase in the length of the radiating element to realize the multi band resonance of PIFA 10. In general, the increase in the size of the ground plane has the effect of decreasing the resonant frequencies. The above observation holds good uniformly to all the further embodiments of this invention also.

Figure 3A:
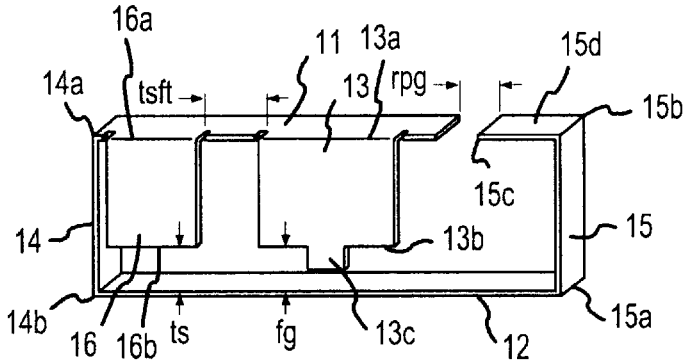
FIG. 3 shows another embodiment of a PIFA illustrative of the present invention.
Figure 3B:
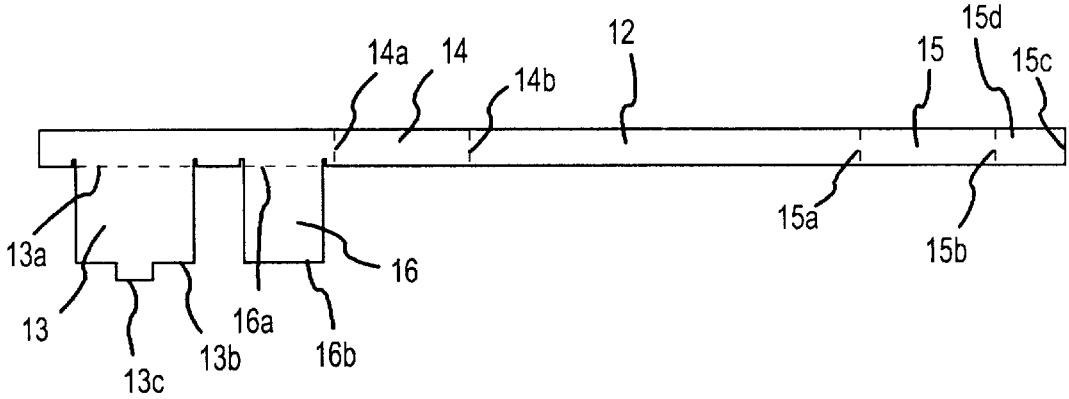

FIGS. 3A and 3B show a Tri ISM band PIFA 20. PIFA 20 operates over frequency ranges 2.4–2.5 GHz, 5.15–5.35 GHz, and 5.47–5.725 GHz. PIFA 20 contains radiating element 11, ground plane 12, feed tab 13, short 14, parasitic element 15, and a tuning stub 16. PIFA 20 may have a feed tab extension 13*c* attached to feed tab 13. FIG. 3B shows PIFA 20 in a flat configuration.

Feed tab 13 has a first feed tab edge 13*a* connected to radiating element 11. In the bent configuration, feed tab 13 has a second feed tab edge 13*b* that resides above ground plane 12. In this example, second feed tab edge 13*b* has a protrusion 13*c* attached to it and extending toward ground plane 12. While shown rectangular, protrusion 13*c* could have other geometric configurations, such as semi-circular, square, elliptical, triangular, or the like. Short 14 has first short edge 14*a* connected to radiating element 11 and second short edge 14*b* connected to ground plane 12 to provide a short between radiating element 11 and ground plane 12. In this case, parasitic element 15 has a first parasitic edge 15*a* connected to ground plane 12 opposite short 14. In other words, second short edge 14*b* is connected to a first end of ground plane 12 and first parasitic edge 15*a* is connected to a second end of ground plane 12 opposite the first end. Parasitic element 15 extends above ground plane 12 parallel to short 14. Parasitic element 15 has a second parasitic edge 15*b* that resides in the plane of radiating element 11. A bend in parasitic element 15 exists at second parasitic edge 15*b*. While shown as extending at a 90 degree angle, parasitic element 15 could angle forwards or away from short 14, also. A generally horizontal portion 15*d* of parasitic element 15 extends from second parasitic edge 15*b* to third parasitic edge 15*c*. Horizontal portion 15*d* is shown parallel to ground plane 12, although horizontal portion 15*d* could angle away or towards ground plane 12. A radiating element to parasitic element gap rpg exists between radiating element 11 and parasitic element 15. As can be seen, parasitic element forms an L-shape. PIFA 20 also contains a tuning stub 16. Tuning stub 16 has a first tuning stub edge 16*a* connected to radiating element 11 between first short edge 14*a* and first feed tab edge 13*a*. Tuning stub 16 has a second tuning stub edge that resides above ground plane 12. A tuning stub gap ts exists between ground plane 12 and second tuning stub edge 16*b*. A gap tsft exist between stub 16 and tab 13. As can be seen in FIG. 3A, short 14 and parasitic element 15 exist at opposite ends of ground plane 12 and run parallel to each other at a width equal to radiating element 11.

Tuning stub 16 controls the resonance and the bandwidth characteristics of the upper frequency band of radiating element 11. Otherwise, PIFA 20 is similar in operation as PIFA 10. PIFA 20 functions as a single feed Tri ISM band PIFA. The resonant frequency of the lower frequency band and the bandwidth of radiating element 11 are determined by the dimensions of radiating element 11, the size of ground plane 12, the location and the width of feed tab 13, the separation distance between the shorting 14 and the tuning stub 16, the width of short 14, as well as by the distance between ground 12 and radiating element 11. Further, gap rpg influences the lower resonant frequency.

The resonant frequency of the upper frequency band and the bandwidth of radiating element 11 are determined by the location and width of feed tab 13, gap fg, gap tsft, as well as the distance between ground 12 and radiating element 11. Parasitic element 15 has little influence on the upper resonant frequency. Connecting a conventional power cable to feed tab 13 can influence the upper resonant frequency.

Figure 4:
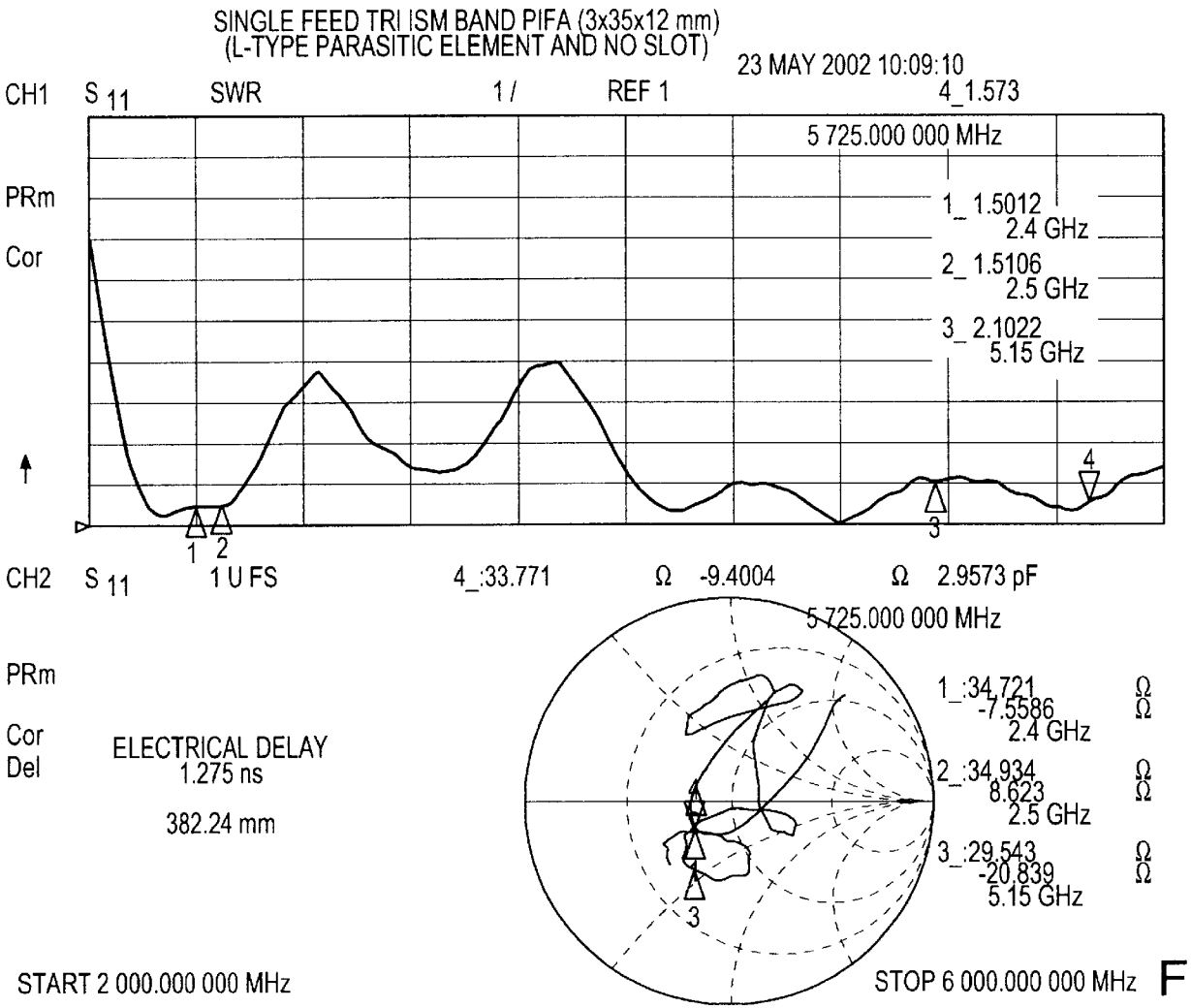
FIG. 4 shows VSWR and impedance characteristics of a sample PIFA 20.

FIG. 4 shows a VSWR and impedance characteristic of a sample PIFA 20 having radiating element dimensions of 3(W)×35(L)×10(H) mm and ground plane dimensions of 3(W)×35(L) mm with operating frequencies of 2.4–2.5 GHz, 5.15–5.35 GHZ, and 5.47–5.725 GHz. The possible variation in the width of the radiating element ranges from a very small value of 2 mm to as wide as 8–9 mm. The width of the ground plane should be just the width of the radiating element or larger than the width of the radiating element. These dimensions are exemplary, however, and one of ordinary skill in the art would understand the dimensions could vary over a wide range. These plots demonstrate satisfactory bandwidth for a PIFA 20 covering Bluetooth protocols, Hiper LAN frequency bands as well as the 5.15–5.35 GHz bandwidth. Similar to PIFA 10, PIFA 20 is a single band PIFA without a slot in the radiating element, and without an increase in the overall physical size or volume of a conventional single band PIFA structure.

Figure 5A:
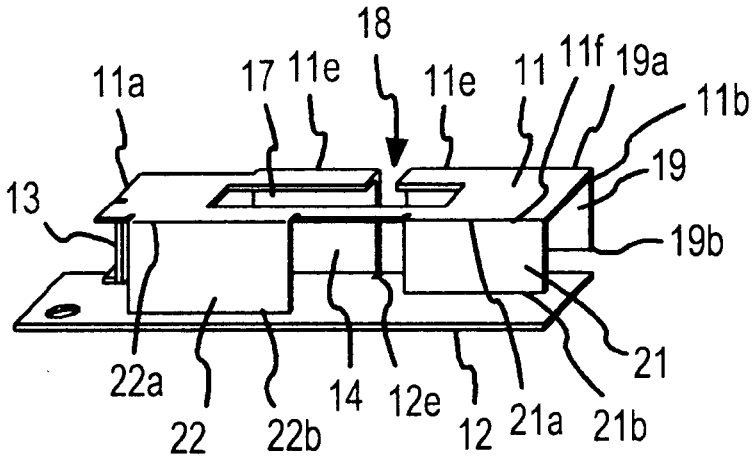
FIG. 5 shows still another embodiment of a PIFA illustrative of the present invention.
Figure 5B:
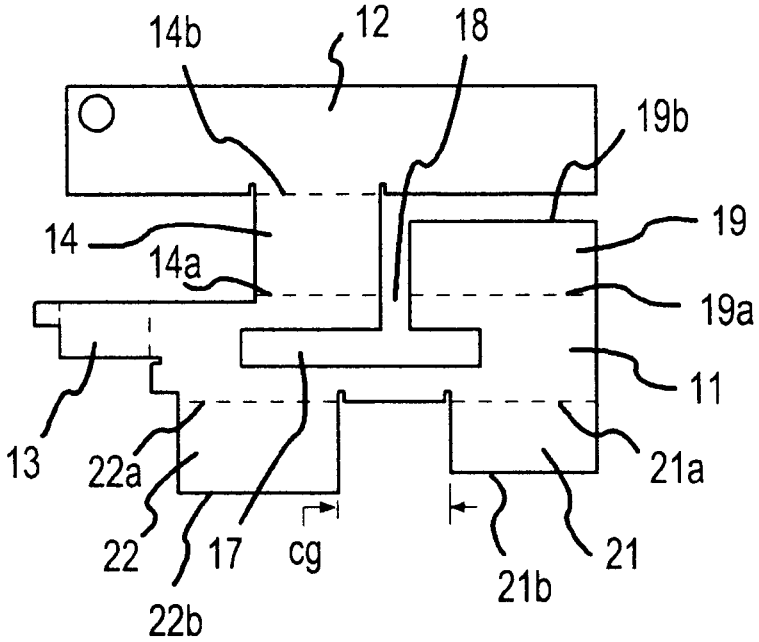

FIGS. 5A and 5B show single feed Tri ISM band PIFA 30. PIFA 30 has radiating element 11, ground plane 12, feed tab 13, short 14, a slot 17, and first conducting strip 19, second conducting strip 21, and third conducting trip 22. Unlike PIFAs 10 and 20, PIFA 30 has a slot 17 on radiating element 11, making radiating element 11 potentially wider in this embodiment than the widths associated with PIFA 10 and 20. However, PIFA 30 does not need a parasitic element, although one of ordinary skill in the art would recognize a parasitic element could be included. In this case, radiating element 11 has a T-shaped slot 17. Slot 17 can have various configurations, such as the L-shaped slot shown in FIGS. 9 and 11. T-shaped slot 17 facilitates the quasi-physical partitioning of radiating element 11 to realize the multi frequency operation of PIFA 30.

PIFA 30 has radiating element 11 and ground plane 12 extending generally parallel to each other. Radiating element 11 has a first edge 11*a* and a second edge 11*b*. Feed tab 13 has first feed tab edge 13*a* attached to first edge 11*a* radiating element 11. Feed tab 13 is parallel to first edge 11*a* and terminates at second feed tab edge 13*b*, which resides above ground plane 12. Contrary to PIFAs 10 and 20, feed tab 13 is parallel to the first edge 11*a*. Short 14 has first short edge 14*a* connected to radiating element 11 along a parallel edge 11*e* of radiating element 11 and second short edge 14*b*connected to ground plane 12 along a parallel edge 12*e* of ground plane 12 to provide a short, which is contrary to PIFAs 10 and 20. Short 14 and feed tab 13 reside on a first side of slot 17. A first conducting strip 19 has a first conducting strip first edge 19*a* attached to radiating element I 1 along the same parallel edge 11*e* as short 14, but across slot gap 18 so that it is attached on a second side of slot 17. First conducting strip 19 has a first conducting strip second edge 19*b* that resides above ground plane 12. Second conducting strip 21 having a second conducting strip first edge 21*a* attached to a second parallel edge 11*f* of radiating element 11 and third conducting strip 22 having a third conducting strip first edge 22*a* attached to second parallel edge 11*f* of radiating element 11. Conducting strip 21 is opposite conducting strip 19 and conducting strip 22 is opposite short 14. Second and third Conducting strips 21 and 22 are separated by a conducting strip gap cg. Second conducting strip 21 has a second conducting strip second edge 21*b* that resides a predetermined distance above ground plane 12. Third conducting strip 22 has a third conducting strip second edge 22*b* that resides a predetermined distance above ground plane 12. First conducting strip second edge 19*b*, second conducting strip second edge 21*b*, and third conducting strip second edge 22*b* can reside a different distances above ground plane 12, but they could reside at the same distance. First, second, and third conducting strips 19, 21, and 22 act as tuning stubs, similar to tuning stub 16 for PIFA 20. The locations of each of the first, second, and third conductive strips enable tuning of a specific resonant band frequency. For example, conducting strips 19 and 21 have a greater influence to tune the resonance of the lower frequency band while conducting strip 22 has a greater influence on the upper band.

PIFA 30 functions as a single feed Tri ISM band PIFA. The resonant frequency of the lower frequency band and the bandwidth of radiating element 11 are determined by the dimensions of radiating element 11, the distance between radiating element 11 and ground plane 12, the size of ground plane 12, the location and width of feed stub 13, the width of short 14, the position of slot 17 in radiating element 11 as well as its dimensions (including gap 18), the location and width of first conducting strip 19, the predetermined distance between ground plane 12 and first conducting strip second edge 19*b*, the location and width of second conducting strip 21, and the predetermined distance between ground plane 12 and second conducting strip second edge 21*b*.

The resonant frequency of the upper frequency band and the bandwidth of radiating element 11 are determined by the location and width of third conductive strip 22, the predetermined distance between ground plane 12 and third conducting strip second edge 22*b*, the position of the T-shaped slot 17 and the dimension of the T-shaped slot 17.

Figure 6:
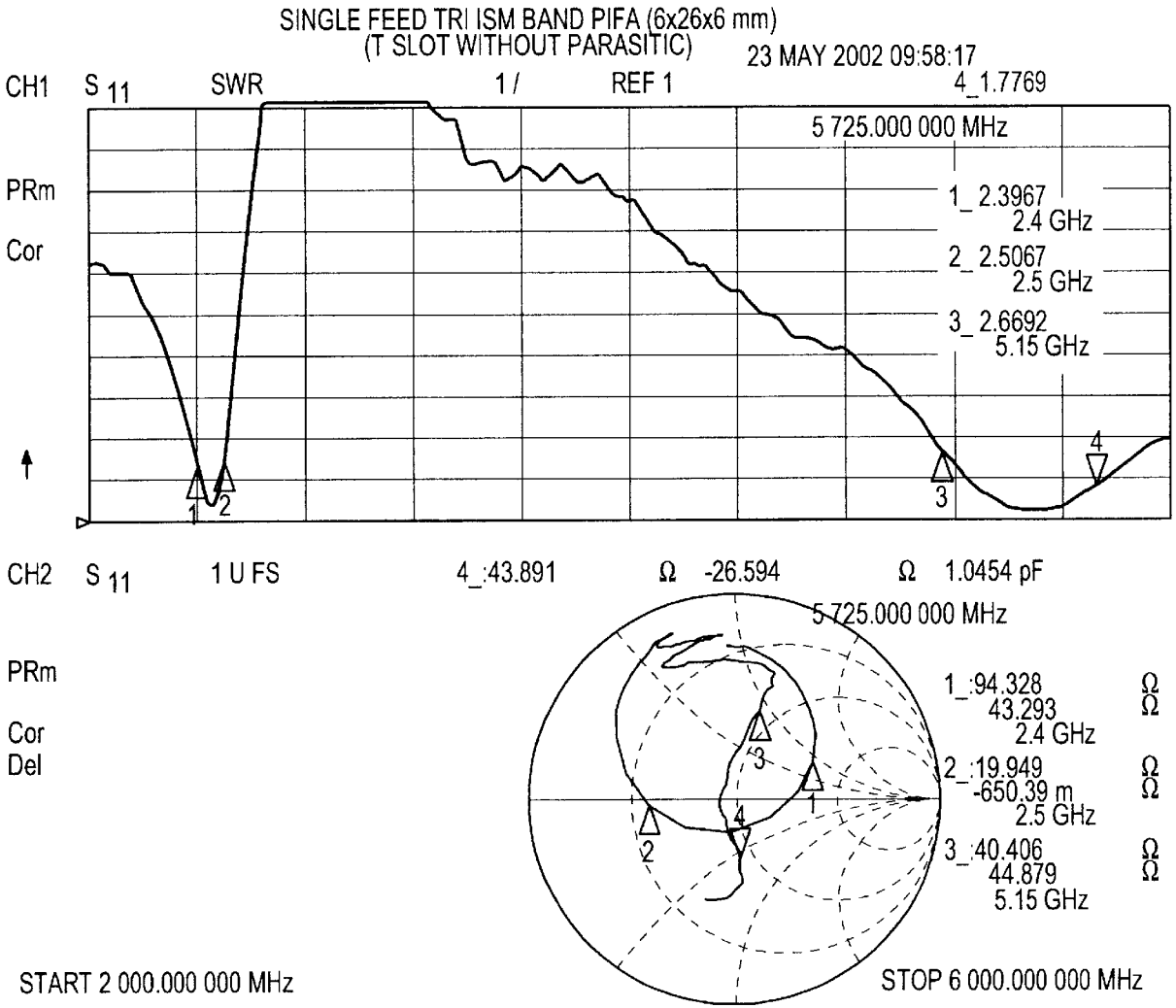
FIG. 6 shows VSWR and impedance characteristics of a sample PIFA 30.

FIG. 6 shows satisfactory VSWR and impedance characteristics of a sample PIFA 30 operating in the 2.4–2.5, 5.15–5.35, and 5.47–5.725 GHz range. The sample PIFA 30 has radiating element 11 dimensions of 6(W)×26(L)×6(H) mm and ground plane 12 dimensions of 6(W)×30(L) mm. The width of the radiating element can vary from as small as 2 mm to as wide as 8–9 mm. The width of the ground plane can be restricted to just the width of the radiating element or it can be larger than the width of the radiating element. For a 6 mm wide radiating element 11 of PIFA 30, the width of the T-shaped slot 17 is about 2 mm. Once again, these dimensions are exemplary.

Figure 7A:
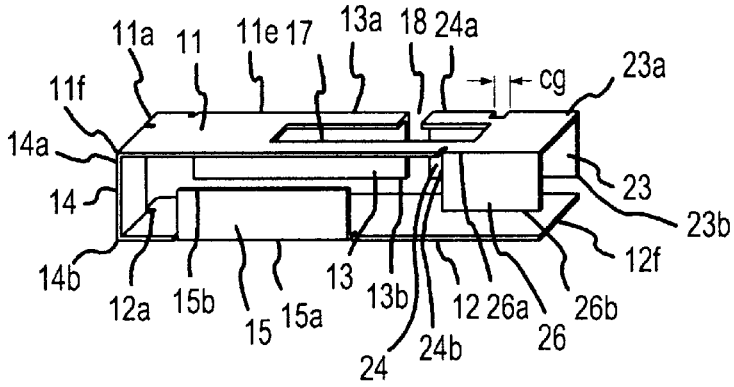
FIG. 7 shows a further embodiment of a PIFA illustrative of the present invention.
Figure 7B:
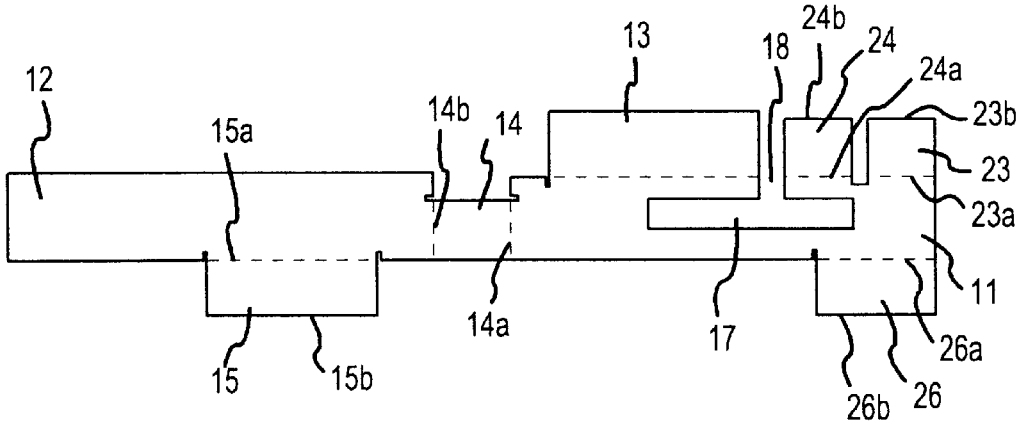

FIGS. 7A and 7B represent a PIFA 40 that combines slot 17 on radiating element 11 with parasitic element 15 on ground plane 12. PIFA 40 comprises radiating element 11, ground plane 12, slot 17, feed tab 13, short 14, parasitic element 15, a first conducting strip 23, a second conducting strip 24, and a third conducting strip 26.

In this case, feed tab 13 has first feed tab edge 13*a* attached to along a parallel edge 11*e* of radiating element 11, which is similar to PIFA 10 and PIFA 20, but contrary to PIFA 30. Second feed tab edge 13*b* resides above ground plane 12. Short 14 has first short edge 14*a* attached to first edge 11*a* and a second short edge 14*b* attached to a first ground plane edge 12*a* to provide a short. Residing opposite gap 18 and along parallel edge 11*e* exists first and second conducting strips 23 and 24, respectively. First conducting strip 23 has a first conducting strip first edge 23*a* attached to parallel edge 11*e*. Second conducting strip 24 has a second conducting strip first edge 24*a* attached to parallel edge 11*e*, also. First and second conducting strips 23 and 24 are separated by a gap cg. First conducting strip 23 has a first conducting strip second edge 23*b* that resides a predetermined distance above ground plane 12. Second conducting strip 24 has a second conducting strip second edge 24*b* that resides a predetermined distance above ground plane 12. The predetermined distance for edges 23*b* and 24*b* from ground plane 12 can be the same or different. A third conducting strip 26 has a third conducting strip first edge 26*a* attached to a parallel edge 11*f* opposite first and second conducting strips 23 and 24. Third conducting strip 26 has a third conducting strip second edge 26*b* that also resides a predetermined distance above ground plane 12. Conducting strips 23, 24, and 26 are positioned to enable tuning of the lower resonant.

Parasitic element 15 has a first parasitic element edge 15*a* attached to a parallel edge 12*f* of ground plane 12 (generally opposite feed tab 13). A second parasitic element edge 15*b* resides a predetermined distance below radiating element 11. Parasitic element 15 influences the tuning of the upper resonant frequency.

PIFA 40 functions as a single feed Tri ISM band PIFA. The resonant frequency of the lower frequency band and the bandwidth center of radiating element 11 are determined by the dimensions of radiating element 11, the distance between radiating element 11 and ground plane 12, the size of ground plane 12, the location and width of feed stub 13, the width of short 14, the position of slot 17 in radiating element 11 as well as its dimensions (including gap 18), the location and width of first conducting strip 23, the predetermined distance between first conducting strip second edge 23*b* and ground plane 12, the location and width of second conducting strip 24, the predetermined distance between ground plane 12 and second conducting strip second-edge 24*b*, and the predetermined distance between ground plane 12 and second conducting strip second edge 26*b*.

The resonant frequency of the upper frequency band and the bandwidth for radiating element 11 are determined by the dimensions of radiating element 11, the distance between radiating element 11 and ground plane 12, the location and width of feed tab 13, the position of slot 17 in radiating element 11 as well as its dimensions, and the location of the parasitic element 15 with respect to radiating element 11.

Figure 8:
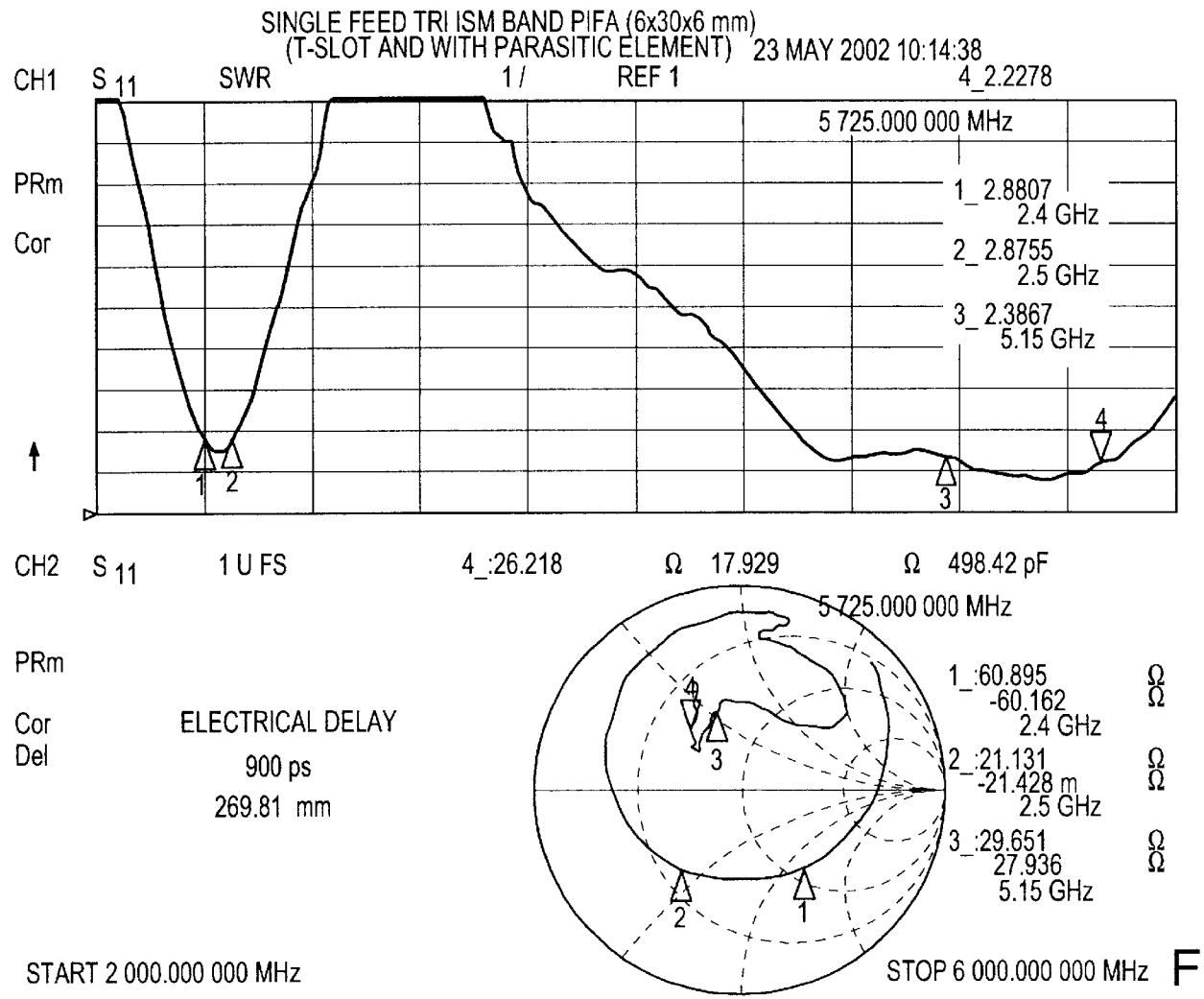
FIG. 8 shows VSWR and impedance characteristics of a sample PIFA 40.

FIG. 8 shows satisfactory VSWR and impedance characteristics of a sample PIFA 40 operating in the 2.4–2.5, 5.15–5.35, and 5.47–5.725 GHz range. The sample PIFA 40 has radiating element 11 dimensions of 6(W)×30(L)×6(H) mm and ground plane 12 dimensions of 6(W)×30(L) mm. The width of the radiating element can typically vary from 2–9 mm. The ground plane and the radiating element can have identical width or the width of the ground plane can be larger than the width of the radiating element. With 6 mm being the width of the radiating element 11 of PIFA 40, the T-shaped slot 17 has a width of about 2 mm.

Figure 9A:
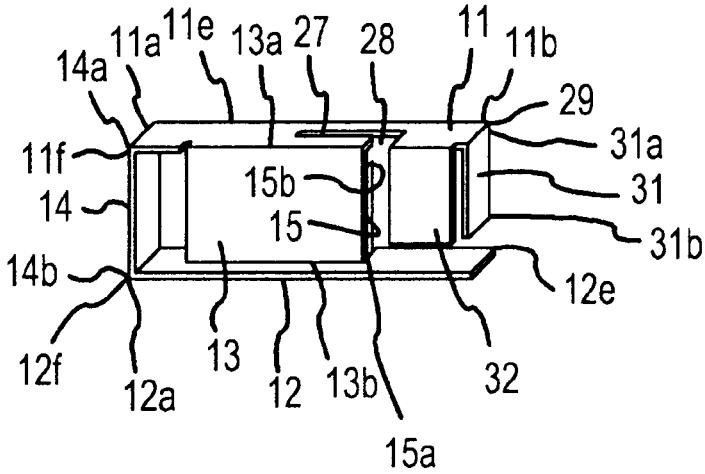
FIG. 9 shows yet a further embodiment of a PIFA illustrative of the present invention.
Figure 9B:
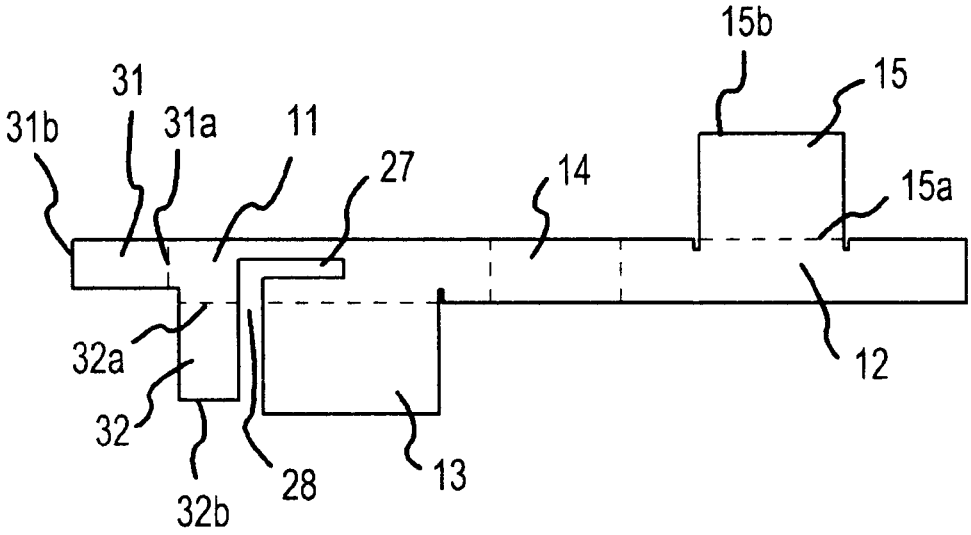

FIGS. 9A and 9B show a PIFA 50. PIFA 50 contains radiating element 11, ground plane 12, a slot 27, in this case an L-shaped slot, feed tab 13, short 14, parasitic element 15, a capacitive loading element 31, and a first conducting strip 32. In this case, radiating element 11 has L-shaped slot 27 to facilitate the quasi-physical partitioning of radiating element 11 to accomplish the dual frequency operation.

Feed tab 13 has a first feed tab edge 13*a* attached to a parallel edge 11*f* of radiating element 11. Feed tab 13 has a second feed tab edge 13*b* residing a predetermined distance above ground plane 12. Short 14 has first short edge 14*a* attached to first edge 11 a of radiating element 11 and second short edge 14*b* attached to ground plane edge 12*a* to provide a short between radiating element 11 and ground plane 12. Generally opposite feed tab 13 resides parasitic element 15 having first parasitic edge 15*a* attached to parallel edge 12*e*. Parasitic element 15 has second parasitic edge 15*b* residing below radiating element 11 a predetermined distance. A capacitive loading element 31 has a first loading element first edge 31*a* attached to a second edge 29 of radiating element 11. Generally, element 31 and radiating element 11 form a substantially 90 degree angle, with loading element 31 extending towards ground plane 12. Loading element 31 is generally parallel to short 14 and has a second loading element edge 31*b* residing a predetermined distance above ground plane 12. A first conducting strip 32 has a first conducting strip first edge 32*a* attached to parallel edge 11*f*, opposite gap 28 of slot 27, such that feed tab 13 resides on one side of gap 28 and first conducting strip 32 resides on the other. First conducting strip 32 has a first conducting strip second edge 32*b* residing a predetermined distance above ground plane 12.

The vertical capacitive loading element 31 offers a reactive loading to the lower resonant band of PIFA 50. First conducting strip 32 tunes the lower frequency band. The parasitic element generally controls the tuning of the upper frequency band. Otherwise, operation of PIFA 50 is similar to PIFA 40.

PIFA 50 functions as a single feed Tri ISM band PIFA. The resonant frequency of the lower frequency band and the bandwidth of radiating element 11 are determined by the dimensions of radiating element 11, the distance between radiating element 11 and ground plane 12, the size of ground plane 12, the location and width of feed stub 13, the width of short 14, the position of slot 27 in radiating element 11 as well as its dimensions (including gap 28), the location and width of first conducting strip 32, the predetermined distance between ground plane 12 and first conducting strip second edge 32*b*, the width of capacitive element 31 and the distance of the second loading element 31*b* above ground plane 12.

The resonant frequency of the upper frequency band and the bandwidth of radiating element 11 are determined by the dimensions of radiating element 11, the distance between radiating element 11 and ground plane 12, the size of ground plane 12, the location and width of feed tab 13, the position of slot 27 and its dimensions (including gap 28), and the location of parasitic element 15 with respect to radiating element 11.

Figure 10:
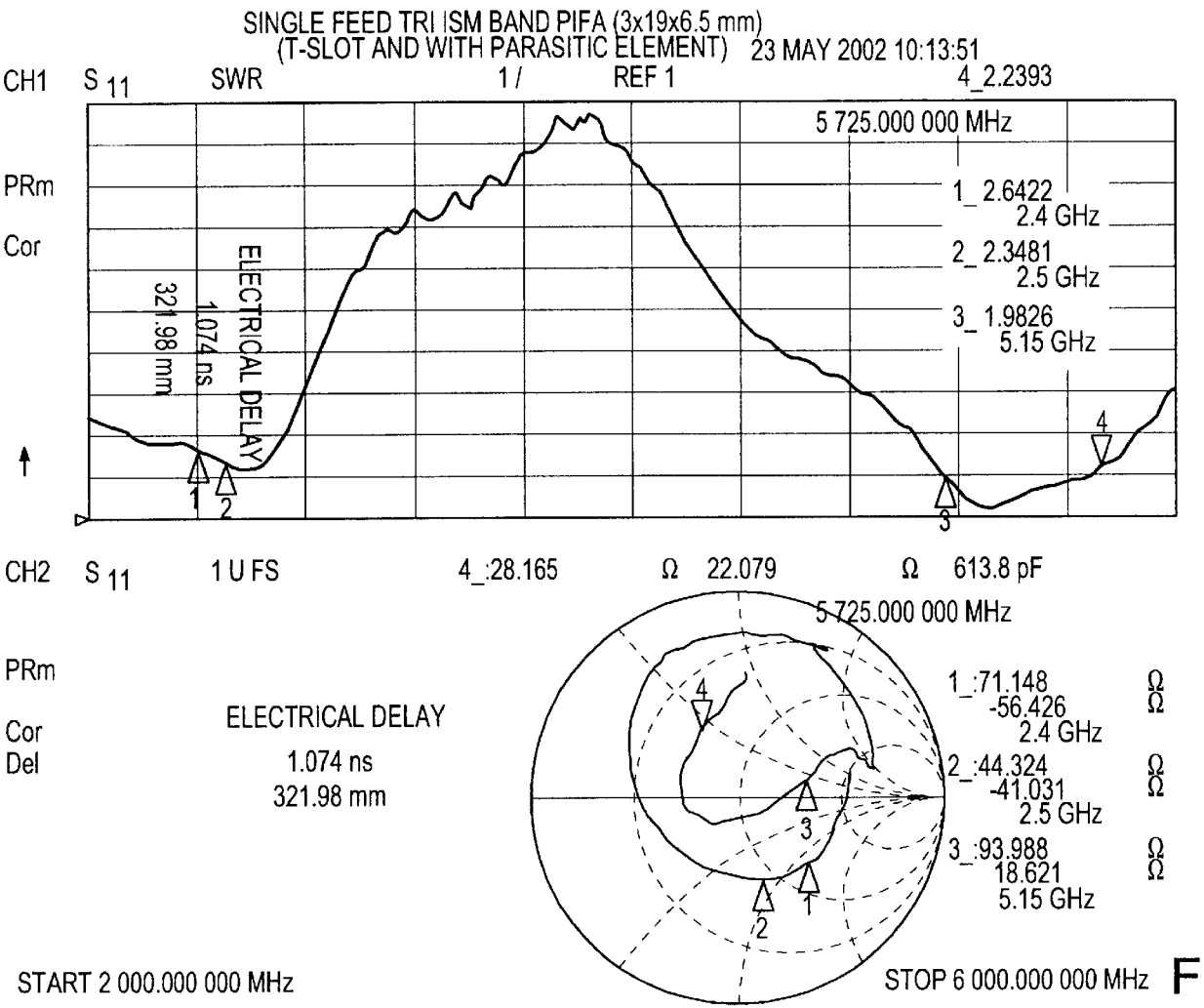
FIG. 10 shows VSWR and impedance characteristics of a sample PIFA 50.

FIG. 10 shows satisfactory VSWR and impedance characteristics of a sample PIFA 50 operating in the 2.4–2.5, 5.15–5.35, and 5.47–5.725 GHz range. The sample PIFA 50 has radiating element 11 dimensions of 3(W)×19(L)×6.5(H) mm and ground plane 12 dimensions of 3(W)×19(L). The width of the radiating element 11 can be allowed to vary between 2–9 mm. The multi ISM band PIFA 50 can incorporate the same width for both the radiating element and the ground plane. Alternatively, the ground plane can also be made much wider than that of the radiating element. With the choice of 3 mm wide radiating element 11 of PIFA 50, the L-shaped slot 27 has a width of about 0.8 mm.

Figure 11A:
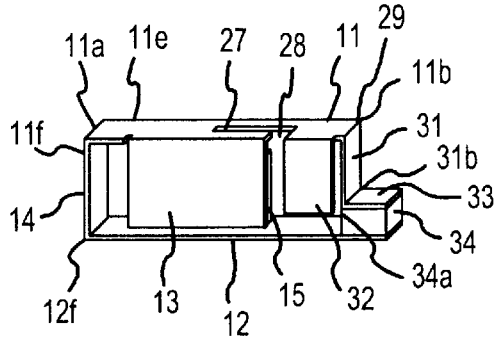
FIG. 11 shows still a further embodiment of a PIFA illustrative of the present invention.
Figure 11B:
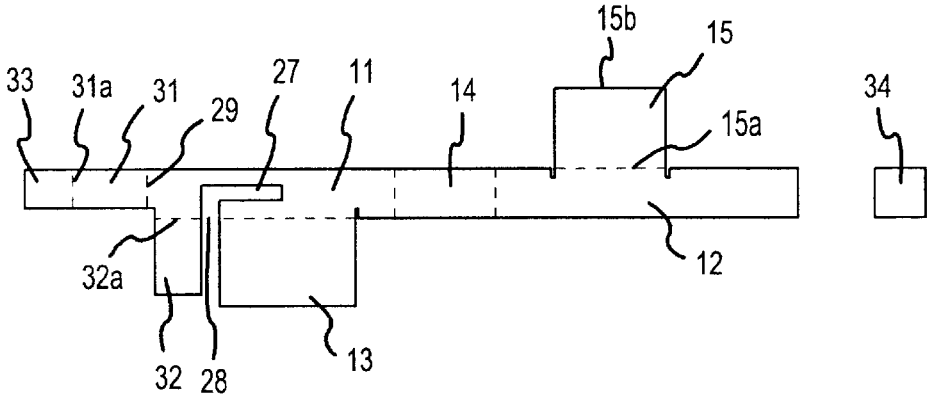

FIGS. 11A and 11B show a PIFA 60. PIFA 60 contains radiating element 11 having slot 27 above ground plane 12. While similar to PIFA 50, explained with reference to FIGS. 9A and 9B, PIFA 60 has vertical capacitive loading plate 31 and horizontal capacitive loading plate 33 that allows PIFA 60 to be relatively narrower than PIFA 50, as will be explained further below.

PIFA 60 operates similar to PIFA 50 and only the different parts will be further explained herein. Unlike PIFA 50, radiating element 11 for PIFA 60 is somewhat longer (in the length dimension) to facilitate horizontal capacitive loading plate 33. As shown, vertical capacitive loading plate 31 has second loading element edge 31*b* residing above ground plane 12 at a predetermined distance. Horizontal capacitive loading plate 33 has a first horizontal capacitive element edge 34*a* attached to second loading element edge 31*b* such that horizontal capacitive loading plate 33 is generally horizontal and parallel to ground plane 12. A dielectric spacer 34 having predetermined dielectric constants and size can be placed between horizontal capacitive loading plate 33 and ground plane 12 to increase the capacitive loading.

Figure 12:
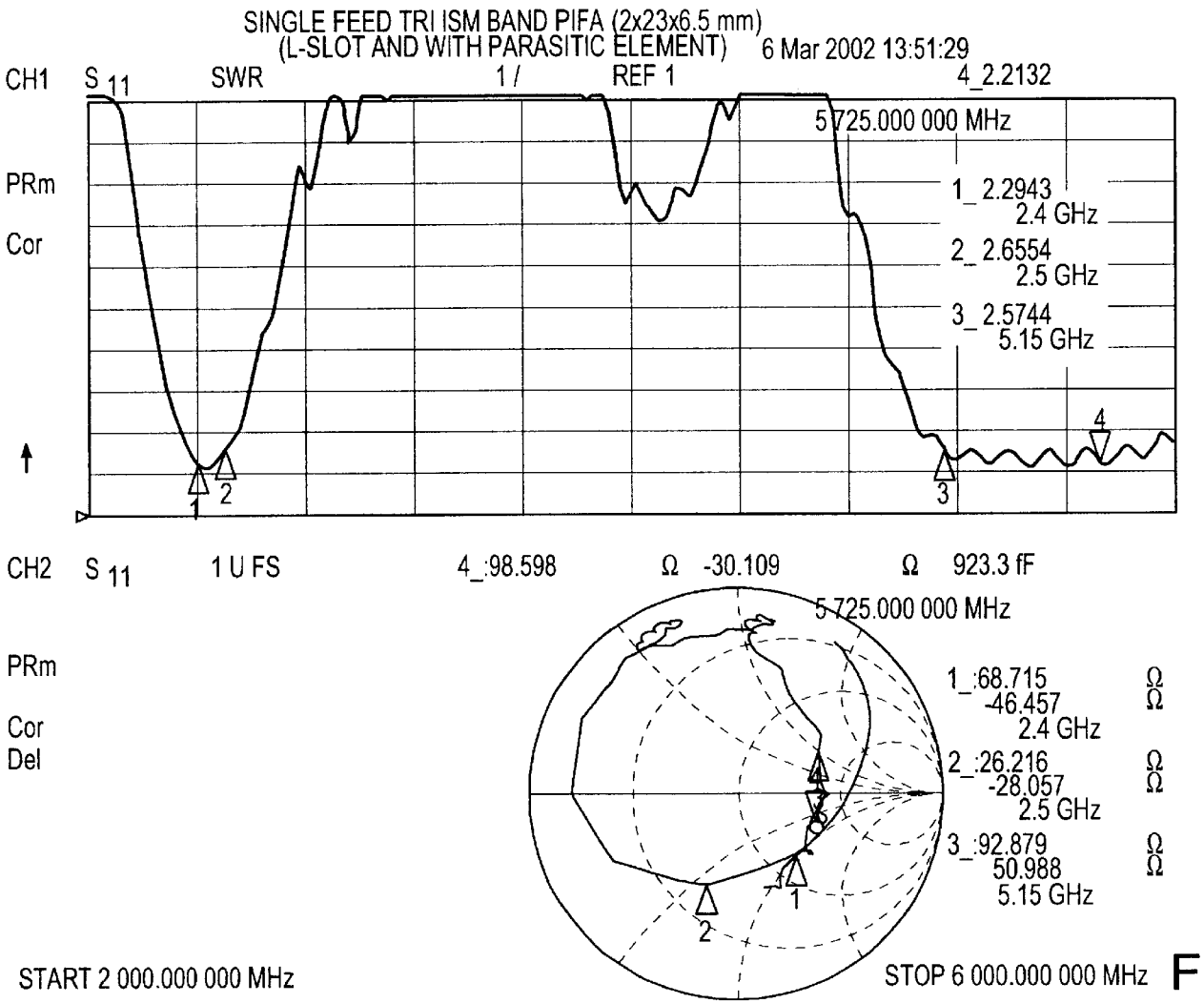
FIG. 12 shows VSWR and impedance characteristics of a sample PIFA 60.

FIG. 12 shows satisfactory VSWR and impedance characteristics of a sample PIFA 50 operating in the 2.4–2.5, 5.15–5.35, and 5.47–5.725 GHz range. The sample PIFA 60 has radiating element 11 dimensions of 2(W)×23(L)×6.5(H) mm and ground plane 12 dimensions of 2(W)×23(L) mm. Although the width of the radiating element 11 can be increased to 8–9 mm, any further decrease in the already very narrow width (2 mm) of the radiating element 11 of PIFA 60 is likely to result in fabrication complexities. To the best of the knowledge of the inventors, the realized design of 2 mm wide multi ISM band PIFA 60 of this invention is purported to have the least width among the published work in open literature. The proposed design can incorporate the same width for both the radiating element and the ground plane. On the contrary, the ground plane can be made much wider than that of the radiating element. The width of the L-shaped slot 27 is about 0.8 mm with the choice of 2 mm wide radiating element 11 of PIFA 60.

While the invention has been particularly shown and described with reference to embodiments thereof, it will be understood by those skilled in the art that various other changes in the form and details may be made without departing from the spirit and scope of the invention.

We claim:

1. An antenna, comprising:

a ground plane;

a radiating element;

a short;

a feed tab; and a parasitic element; wherein, the ground plane comprises a first ground plane edge and a second ground plane edge, the first ground plane edge and the second ground plane edge residing at opposite sides of the ground plane and across a ground plane width;

the ground plane comprises a third ground plane edge and a fourth ground plane edge, the third ground plane edge and the fourth ground plane edge extend between the first ground plane edge and second ground plane edge and reside on opposing sides of the ground plane and along a ground plane length;

the radiating element comprises a first radiating element edge and a second radiating element edge, the first radiating element edge and the second radiating element edge residing at opposite sides of the radiating element and across a radiating element width;

the radiating element comprises a third radiating element edge and a fourth radiating element edge, the third radiating element edge and the fourth radiating element edge extend between the first radiating element edge and the second radiating element edge and reside on opposing sides of the radiating element and along a radiating element length;

the short comprising a first short edge and a second short edge, wherein the first short edge is coupled to the first ground plane edge and the first radiating element edge shorting the ground plane to the radiating element;

the feed tab comprising a first feed tab edge and a second feed tab edge, wherein the first feed tab edge is coupled to the fourth radiating element edge and the second feed tab edge resides a first predetermined distance above the ground plane; and the parasitic element comprising a first parasitic element edge and a second parasitic element edge, wherein the second parasitic element edge is coupled to the third ground plane edge and the first parasitic element edge resides a second predetermined distance below the radiating element.

2. The antenna of claim 1, wherein:

the radiating element and the ground plane are substantially parallel.

3. The antenna of claim 1, wherein:

a single conductor having a plurality of bends forms the ground plane, the parasitic element, the short, the radiating element, and the feed tab.

4. The antenna of claim 3, wherein at least one of the plurality of bends forms a 90 degree angle.

5. The antenna of claim 1, wherein the radiating element length is shorter than the ground plane length.

6. The antenna of claim 1, wherein the parasitic element is closer to the short than the feed tab.

7. The antenna of claim 1, wherein the parasitic element and the feed tab are substantially parallel.

8. The antenna of claim 1, wherein the ground plane width and the radiating element width are same.

9. An antenna, comprising:

a ground plane;

a radiating element;

a short;

a feed tab;

a tuning stub; and a parasitic element, wherein, the ground plane comprises a first ground plane edge and a second ground plane edge, the first ground plane edge and the second ground plane edge residing at opposite sides of the ground plane and across a ground plane width;

the ground plane comprises a third ground plane edge and a fourth ground plane edge, the third ground plane edge and the fourth ground plane edge extend between the first ground plane edge and the second ground plane edge and reside on opposing sides of the ground plane and along a ground plane length;

the radiating element comprises a first radiating element edge and a second radiating element edge, the first radiating element edge and the second radiating element edge residing at opposite sides of the radiating element and across a radiating element width;

the radiating element comprises a third radiating element edge and a fourth radiating element edge, the third radiating element edge and the fourth radiating element edge extend between the first radiating element edge and the second radiating element edge and reside on opposing sides of the radiating element and along a radiating element length;

the short comprising a first short edge and a second short edge, wherein the first short edge is coupled to the first ground plane edge and the first radiating element edge shorting the ground plane to the radiating element;

the feed tab comprising a first feed tab edge and a second feed tab edge, wherein the first feed tab edge is coupled to the fourth radiating element edge and the second feed tab edge resides a first predetermined distance above the ground plane;

the tuning stub comprising a first tuning stub edge and a second tuning stub edge, wherein the first tuning stub edge is coupled to the fourth radiating element edge and the second tuning stub edge resides a second predetermined distance above the ground plane; and the parasitic element comprises a first vertical plate edge, a vertical plate, a second vertical plate edge, a horizontal plate, a first horizontal plate edge and a second horizontal plate edge, wherein the first vertical plate edge is coupled to the second ground plane edge such that the vertical plate extends above the ground plane and the second vertical plate edge is coupled to the second horizontal plate edge such that the horizontal plate extends towards the second radiating element edge.

10. The antenna of claim 9, wherein the radiating element and the ground plane are substantially parallel.

11. The antenna of claim 9, wherein the vertical plate and the short are substantially parallel.

12. The antenna of claim 9, wherein the horizontal plate and the radiating element are substantially parallel.

13. The antenna of claim 12, wherein the horizontal plate and the radiating element reside in substantially the same plane.

14. The antenna of claim 9, wherein the tuning stub is coupled to the fourth radiating element edge between the feed tab and the short.

15. The antenna of claim 9, wherein the first predetermined distance and the second predetermined distance are different.

16. The antenna of claim 9, wherein the feed tab has a feed tab extension and the feed tab extension resides a third predetermined distance above the ground plane.

17. The antenna of claim 9, wherein the first horizontal plate edge resides a fourth predetermined distance from the second radiating element edge.

18. The antenna of claim 9, wherein the radiating element length is shorter than ground plane length.

19. The antenna of claim 9, wherein the ground plane width and the radiating element width are same.

20. The antenna of claim 9, wherein:

a single conductor having a plurality of bends forms the ground plane, the parasitic element, the short, the radiating element, the feed tab, and the tuning stub.

21. The antenna of claim 9, wherein the feed tab and the tuning stub are substantially parallel.

22. An antenna, comprising:

a ground plane;

a radiating element;

a slot formed in the radiating element;

a feed tab;

a short;

a first tuning stub;

a second tuning stub; and a third tuning stub; wherein, the ground plane comprises a first ground plane edge and a second ground plane edge, the first ground plane edge and the second ground plane edge residing at opposite sides of the ground plane and across a ground plane width;

the ground plane comprises a third ground plane edge and a fourth ground plane edge, the third ground plane edge and the fourth ground plane edge extend between the first ground plane edge and the second ground plane edge and reside on opposing sides of the ground plane and along a ground plane length;

the radiating element comprises a first radiating element edge and a second radiating element edge, the first radiating element edge and the second radiating element edge residing at opposite sides of the radiating element and across a radiating element width;

the radiating element comprises a third radiating element edge and a fourth radiating element edge, the third radiating element edge and the fourth radiating element edge extend between the first radiating element edge and the second radiating element edge and reside on opposing sides of the radiating element and along a radiating element length;

the short comprising a first short edge and a second short edge, wherein the first short edge is coupled to the third radiating element edge and the second short edge is coupled to the third ground plane edge to short the radiating element to the ground plane;

the feed tab comprising a first feed tab edge and a second feed tab edge, wherein the first feed tab edge is coupled to the first radiating element edge and the second feed tab edge resides a first predetermined distance above the ground plane;

the slot comprising a gap on the third radiating element edge, the gap comprising a first gap side and a second gap side;

the first short edge is coupled on the third radiating element edge between the first gap side and the first radiating element edge;

the first tuning stub comprising a first tuning stub first edge and a first tuning stub second edge, wherein the first tuning stub first edge is coupled to the third radiating element edge and the first tuning stub second edge resides above the ground plane a second predetermined distance and the first tuning stub first edge is coupled on the third radiating element edge between the second gap side and the second radiating element edge;

the second tuning stub comprising a second tuning stub first edge and a second tuning stub second edge, wherein the second tuning stub first edge is coupled to the fourth radiating element edge and the second tuning stub second edge resides above the ground plane a third predetermined distance;

the third tuning stub comprising a third tuning stub first edge and a third tuning stub second edge, wherein the third tuning stub first edge is coupled to the fourth radiating element edge and the third tuning stub second edge resides above the ground plane a fourth predetermined distance; and the third tuning stub is coupled to the fourth radiating element edge between the second tuning stub and the first radiating element edge.

23. The antenna of claim 22, wherein the radiating element and the ground plane are substantially parallel.

24. The antenna of claim 22, wherein the first tuning stub, the second tuning stub, and the third tuning stub are substantially parallel.

25. The antenna of claim 22, wherein the slot forms a T-shape.

26. The antenna of claim 22, wherein the feed tab comprises a feed tab extension.

27. The antenna of claim 26, wherein the feed tab extension extends substantially perpendicular to the feed tab.

28. The antenna of claim 22, wherein the first tuning stub first edge extends along the third radiating element edge to the second radiating element edge and the second tuning stub first edge extends along the fourth radiating element edge to the second radiating element edge.

29. The antenna of claim 22, wherein the radiating element length is shorter than the ground plane length.

30. The antenna of claim 22, wherein the radiating element width and the ground plane width are same.

31. The antenna of claim 22, wherein at least one of the first predetermined distance, the second predetermined distance, the third predetermined distance, and the fourth predetermined distance are different.

32. An antenna, comprising:

a ground plane;

a radiating element;

a slot formed in the radiating element;

a feed tab;

a short;

a first tuning stub;

a second tuning stub;

a third tuning stub, and a parasitic element; wherein, the ground plane comprises a first ground plane edge and a second ground plane edge, the first ground plane edge and the second ground plane edge residing at opposite sides of the ground plane and across a ground plane width, the ground plane comprises a third ground plane edge and a fourth ground plane edge, the third ground plane edge and the fourth ground plane edge extend between the first ground plane edge and the second ground plane edge and reside on opposing sides of the ground plane and along a ground plane length, the radiating element comprises a first radiating element edge and a second radiating element edge, the first radiating element edge and the second radiating element edge residing at opposite sides of the radiating element and across a radiating element width;

the radiating element comprises a third radiating element edge and a fourth radiating element edge, the third radiating element edge and the fourth radiating element edge extend between the first radiating element edge and the second radiating element edge and reside on opposing sides of the radiating element and along a radiating element length;

the short comprising a first short edge and a second short edge, wherein the first short edge is coupled to the first radiating element edge and the second short edge is coupled to the first ground plane edge to short the radiating element to the ground plane;

the feed tab comprising a first feed tab edge and a second feed tab edge, wherein the first feed tab edge is coupled to the third radiating plane edge and the second feed tab edge resides a first predetermined distance above the ground plane;

the slot comprising a gap on the third radiating element edge, the gap comprising a first gap side and a second gap side;

the first feed tab edge is coupled on the third radiating element edge between the first gap side and the first radiating element edge, the first tuning stub comprising a first tuning stub first edge and a first tuning stub second edge, wherein the first tuning stub first edge is coupled to the third radiating element edge and the first tuning stub second edge resides above the ground plane a second predetermined distance, the first tuning stub first edge is coupled on the third radiating element edge between the second gap side and the second radiating element edge;

the second tuning stub comprising a second tuning stub first edge and a second tuning stub second edge, wherein the second tuning stub first edge is coupled to the third radiating element edge and the second tuning stub second edge resides above the ground plane a third predetermined distance;

the first tuning stub located closer to the second gap side than the second tuning stub;

the third tuning stub comprising a third tuning stub first edge and a third tuning stub second edge, wherein the third tuning stub first edge is coupled to the fourth radiating element edge and the third tuning stub second edge resides above the ground plane a fourth predetermined distance;

the parasitic element comprising a parasitic element first edge and a parasitic element second edge, wherein the parasitic element second edge is coupled to the fourth ground plane edge and the parasitic element first edge resides below the radiating element a fifth predetermined distance; and the parasitic element is coupled to the fourth ground plane edge closer to the short than the third tuning stub.

33. The antenna of claim 32, wherein the radiating element and the ground plane are substantially parallel.

34. The antenna of claim 32, wherein the first tuning stub, the second tuning stub, and the third tuning stub are substantially parallel.

35. The antenna of claim 34, wherein the feed tab and the parasitic element are also substantially parallel with the first tuning stub.

36. The antenna of claim 32, wherein the slot forms a T-shape.

37. The antenna of claim 32, wherein the first tuning stub first edge extends along the third radiating element edge to the second radiating element edge and the second tuning stub first edge extends along the fourth radiating element edge to the second radiating element edge.

38. The antenna of claim 32, wherein the radiating element length is shorter than the ground plane length.

39. The antenna of claim 32, wherein the radiating element width and the ground plane width are same.

40. The antenna of claim 32, wherein at least one of the first predetermined distance, the second predetermined distance, the third predetermined distance, the fourth predetermined distance, and the fifth predetermined distance are different.

41. An antenna, comprising:

a ground plane;

a radiating element;

a slot formed in the radiating element;

a feed tab;

a short;

a tuning stub;

a parasitic element; and a vertical plate; wherein, the ground plane comprises a first ground plane edge and a second ground plane edge, the first ground plane edge and the second ground plane edge residing at opposite sides of the ground plane and across a ground plane width;

the ground plane comprises a third ground plane edge and a fourth ground plane edge, the third ground plane edge and the fourth ground plane edge extend between the first ground plane edge and the second ground plane edge and reside on opposing sides of the ground plane and along a ground plane length, the radiating element comprises a first radiating element edge and a second radiating element edge, the first radiating element edge and the second radiating element edge residing at opposite sides of the radiating element and across a radiating element width;

the radiating element comprises a third radiating element edge and a fourth radiating element edge, the third radiating element edge and the fourth radiating element edge extend between the first radiating element edge and the second radiating element edge and reside on opposing sides of the radiating element-and along a radiating element length;

the short comprising a first short edge and a second short edge, wherein the first short edge is coupled to the first radiating element edge and the second short edge is coupled to the first ground plane edge to short the radiating element to the ground plane;

the feed tab comprising a first feed tab edge and a second feed tab edge, wherein the first feed tab edge is coupled to the fourth radiating element edge and the second feed tab edge resides a first predetermined distance above the ground plane;

the slot comprising a gap on the fourth radiating element edge, the gap comprising a first gap side and a second gap side;

the first feed tab edge is coupled on the fourth radiating element edge between the first gap side and the first radiating element edge;

the tuning stub comprising a first tuning stub edge and a second tuning stub edge, wherein the first tuning stub edge is coupled to the fourth radiating element edge and the second tuning stub edge resides a second predetermined distance above the ground plane, the tuning stub is coupled to the fourth radiating element edge between the second gap side and the second radiating element edge;

the parasitic element comprising a first parasitic edge and a second parasitic edge, wherein the second parasitic edge is coupled to the third ground plane edge and the first parasitic edge resides below the radiating element a third predetermined distance; and the vertical plate comprises a first vertical plate edge and a second vertical plate edge, wherein the first vertical plate edge is coupled to the second radiating element edge and the second vertical plate edge resides above the ground plane a fourth predetermined distance.

42. The antenna of claim 41, wherein the slot is L-shaped.

43. The antenna of claim 42, wherein the horizontal segment of L-shaped slot runs substantially parallel to the feed tab.

44. The antenna of claim 41, wherein the parasitic element is closer to the first ground plane edge than the second ground plane edge.

45. The antenna of claim 41, wherein the radiating element and the ground plane are substantially parallel.

46. The antenna of claim 41, wherein the feed tab, the tuning stub, and the parasitic element are substantially parallel.

47. The antenna of claim 41, wherein the vertical plate and the short are substantially parallel.

48. The antenna of claim 41, further comprising a horizontal plate comprising a first horizontal plate edge and a second horizontal plate edge; and the first horizontal plate edge is coupled to the second vertical plate edge.

49. The antenna of claim 48, further comprising:

a dielectric material residing between the horizontal plate and the ground plane.

50. The antenna of claim 48, wherein the horizontal plate is substantially parallel to the ground plane.

* * * * *